US011302266B2

(12) United States Patent
Jung

(10) Patent No.: US 11,302,266 B2
(45) Date of Patent: Apr. 12, 2022

(54) ORGANIC LIGHT EMITTING DIODE DISPLAY DEVICE

(71) Applicant: LG Display Co., Ltd., Seoul (KR)

(72) Inventor: Jea-Hun Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/118,060

(22) Filed: Dec. 10, 2020

(65) Prior Publication Data

US 2021/0201828 A1 Jul. 1, 2021

(30) Foreign Application Priority Data

Dec. 26, 2019 (KR) ..... 10-2019-0174683

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/0297* (2013.01); *G09G 2310/08* (2013.01)

(58) Field of Classification Search
CPC .. G09G 3/2092; G09G 3/3208; G09G 3/3233; G09G 3/3291; G09G 3/3696; G09G 3/006; G09G 2300/0426; G09G 2300/043; G09G 2300/0814; G09G 2300/0819; G09G 2300/0842; G09G 2300/0866; G09G 2310/0297; G09G 2310/08; G09G 2320/0233; G09G 2320/0295; G09G 2320/045; G09G 2320/0626
See application file for complete search history.

(56) References Cited

U.S. PATENT DOCUMENTS

2013/0050292 A1* 2/2013 Mizukoshi ..... G09G 3/3291 345/690
2013/0169699 A1* 7/2013 Jeong ..... G09G 3/3225 345/690
2015/0001504 A1* 1/2015 Kim ..... H01L 27/32 257/40
2015/0123953 A1* 5/2015 Shim ..... G09G 3/3233 345/205

(Continued)

FOREIGN PATENT DOCUMENTS

KR 10-2015-0078648 A 7/2015
KR 10-2016-0142015 A 12/2016
KR 10-2018-0057752 A 5/2018

*Primary Examiner* — Michael J Eurice
(74) *Attorney, Agent, or Firm* — Seed IP Law Group LLP

(57) ABSTRACT

An organic light emitting diode (OLED) display device is disclosed. In the OLED display device, a timing controller compares reference voltages output from driving integrated circuits (driving ICs). When a deviation occurs in the reference voltages, the timing controller compensates for the deviation of reference voltages. The OLED display device includes a display panel having reference voltage lines and a plurality of pixels, a data driving circuit having a plurality of driving ICs to generate reference voltages and to supply the reference voltages to the reference voltage lines of the display panel, and a timing controller for comparing reference voltages respectively output from the driving ICs to the display panel, thereby controlling the driving ICs such that the reference voltages respectively output from the driving ICs are equalized.

6 Claims, 4 Drawing Sheets

(56) References Cited

U.S. PATENT DOCUMENTS

| | | | | |
|---|---|---|---|---|
| 2016/0062548 | A1* | 3/2016 | Kwon | G06F 3/042 345/173 |
| 2016/0189612 | A1* | 6/2016 | Lee | G09G 3/2003 345/690 |
| 2016/0189629 | A1* | 6/2016 | Jin | G09G 3/3233 345/211 |
| 2016/0351095 | A1* | 12/2016 | Tani | G09G 3/3283 |
| 2017/0025061 | A1* | 1/2017 | Takizawa | G09G 3/3291 |
| 2018/0182278 | A1* | 6/2018 | Kim | G09G 3/3233 |
| 2021/0201810 | A1* | 7/2021 | Feng | G09G 3/3233 |

* cited by examiner

ORGANIC LIGHT EMITTING DIODE DISPLAY DEVICE

CROSS-REFERENCE TO RELATED APPLICATION

This application claims the benefit of Korean Patent Application No. 10-2019-0174683, filed Dec. 26, 2019, which is hereby incorporated by reference as if fully set forth herein.

BACKGROUND

Technical Field

The present disclosure relates to an organic light emitting diode (OLED) display device, and more particularly to an OLED display device capable of compensating for a deviation of reference voltages for each driving integrated circuit (IC).

Description of the Related Art

Representative examples of display devices recently developed to display an image using digital data include a liquid crystal display (LCD) device using liquid crystals, an organic light emitting diode (OLED) display device using OLEDs, and an electrophoretic display (EPD) device using electrophoretic particles.

Among these display devices, the OLED display device is a self-luminous device in which an organic light emitting layer emits light through re-combination of electrons and holes. The OLED display device may exhibit high brightness while using a low driving voltage, and may have advantages of fast response time, high light emission efficiency, high luminance and a wide viewing angle. The OLED display device may also achieve ultra-slimness. In this regard, the OLED display device is expected to be a next-generation display device.

Each of pixels constituting such an OLED display device includes an OLED element, and a pixel circuit configured to independently drive the OLED element.

The OLED element includes an anode, a cathode, and an organic compound layer formed between the anode and the cathode. The organic compound layer includes a hole injection layer HIL, a hole transport layer HTL, an emission layer EML, an electron transport layer ETL, and an electron injection layer EIL. When a drive voltage is applied between the anode and the cathode, holes passing through the hole transport layer HTL and electrons passing through the electron transport layer ETL migrate to the emission layer EML and, as such, excitons are produced. As a result, the emission layer EML generates visible light.

The pixel circuit includes a driving thin film transistor (TFT) for controlling driving current IOLED flowing through the OLED element in accordance with a gate-source voltage Vgs, a capacitor for constantly sustaining the gate-source voltage Vgs of the driving TFT for one frame, and at least one switching TFT for setting the gate-source voltage Vgs of the driving TFT in response to a gate signal (scan pulse). Accordingly, the driving TFT adjusts current Ids driving the OLED element in accordance with a gate-source driving voltage Vgs corresponding to image data, thereby adjusting brightness of the OLED element.

When the pixel of the OLED display device exhibits non-uniform characteristics due to variation in threshold voltage Vth, mobility, etc., of the driving TFT according to process deviation, driving environment, driving time, etc., the current Ids may vary with respect to the driving voltage Vgs at the same grayscale level and, as such, a luminance non-uniformity phenomenon may occur.

In order to solve such a problem, the OLED display device mainly utilizes technologies for sensing characteristics of pixels and externally compensating for characteristic deviation, etc., of the pixels based on the sensed results.

A sensing method for extracting a variation in threshold voltage Vth of the driving TFT includes operating the driving TFT in a source follower manner, sensing a source voltage of the driving TFT, and then detecting a variation in threshold voltage of the driving TFT based on the sensed voltage. The threshold voltage variation of the driving TFT is determined in accordance with the level of the sensed voltage. Based on the determined threshold voltage variation, an offset value for data compensation is derived.

In order to regulate current capability characteristics of the driving TFT, except for the threshold voltage Vth of the driving TFT, a sensing method for extracting a variation in mobility μ of the driving TFT includes applying, to a gate of the driving TFT, a predetermined voltage Vdata+X (X being a voltage according to offset value compensation) higher than the threshold voltage of the driving TFT, thereby turning on the driving TFT, and receiving, as a sensing voltage, a source voltage Vs of the driving TFT charged for a predetermined time under the above-mentioned condition. The mobility variation of the driving TFT is determined in accordance with the level of the sensing voltage. Based on the determined mobility variation, a gain value for data compensation is derived.

In order to realize such external compensation methods, a 3T1C pixel circuit has been proposed. In addition to the driving TFT, the capacitor, and the switching TFT, the 3T1C pixel circuit includes a sensing TFT for sensing the threshold voltage of the driving TFT in response to another gate signal (sensing pulse).

A 6T1C pixel circuit has also been proposed to compensate for threshold voltage (Vth) and mobility (μ) deviations of the driving TFT within the pixel circuit, different from the above-mentioned external compensation methods.

In the 3T1C pixel circuit or the 6T1C pixel circuit, it is necessary to supply a reference voltage Vref to each pixel circuit in order to sense the threshold voltage Vth or mobility μ of the driving TFT or to compensate for a deviation of the threshold voltage Vth of the driving TFT.

However, the reference voltage supplied on a driving IC basis may deviate. When the threshold voltage Vth or mobility μ of the driving TFT is sensed or the deviation of the threshold voltage Vth of the driving TFT is compensated for using the deviated reference voltage, correct compensation may not be achieved and, as such, a block dimming phenomenon may occur.

BRIEF SUMMARY

Accordingly, the present disclosure is directed to an organic light emitting diode display device that substantially obviates one or more problems due to limitations and disadvantages of the related art.

An object of the present disclosure is to provide an organic light emitting diode (OLED) display device in which a timing controller compares reference voltages output from driving integrated circuits (IC), thereby being capable of compensating for a deviation of the reference voltages output from the driving ICs when the deviation occurs in the reference voltages d.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, an organic light emitting diode (OLED) display device includes a display panel having reference voltage lines and a plurality of pixels, a data driving circuit having a plurality of driving integrated circuits (ICs) to generate reference voltages and to supply the reference voltages to the reference voltage lines of the display panel, and a timing controller for comparing reference voltages respectively output from the driving ICs to the display panel, thereby controlling the driving ICs such that the reference voltages respectively output from the driving ICs are equalized.

Each pixel of the display panel may include a driving thin film transistor (TFT) for controlling current flowing through a light emitting element, at least one switching TFT for sensing a threshold voltage or mobility of the driving TFT or compensating for a threshold voltage deviation of the driving TFT, and at least one storage capacitor.

The timing controller may compare the reference voltages respectively output from the driving ICs to the display panel, and may control the driving ICs such that a lowest one of the reference voltages output from the driving ICs is output as a reference voltage when a deviation occurs in the reference voltages of the driving ICs.

Each of the driving ICs may include a reference voltage generator for receiving a reference voltage supplied from a power supply, generating a reference voltage based on the received reference voltage, and outputting the generated reference voltage, a reference voltage adjuster for adjusting the reference voltage generated from the reference voltage generator under control of the timing controller, and outputting the adjusted reference voltage to the reference voltage lines of the display panel, and an analog to digital converter for converting the reference voltage output from the reference voltage adjuster into a digital signal, and transmitting the digital signal to the timing controller.

The reference voltage adjuster may include a divider for dividing the reference voltage output from the reference voltage generator into voltages of multiple levels, and a multiplexer for selecting one of the voltages divided in the divider in accordance with a select signal output from the timing controller, and supplying the selected voltage to the reference voltage lines of the display panel as a reference voltage.

It is to be understood that both the foregoing general description and the following detailed description of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and along with the description serve to explain the principle of the disclosure. In the drawings.

DETAILED DESCRIPTION DISCLOSURE

Hereinafter, an organic light emitting diode (OLED) display device according to an exemplary embodiment of the present disclosure having the above-described features will be described in more detail with reference to the accompanying drawings.

Although the following device will be described in conjunction with an example in which the device includes a p-type thin film transistor (TFT), the device may be embodied to include an n-type TFT or to include both the p-type TFT and the n-type TFT. Such a TFT is a 3-electrode element including a gate, a source, and a drain. The source is an electrode for supplying carriers to the TFT. Within the TFT, carriers begin to flow from the source. The drain is an electrode through which carriers migrate outwards from the TFT. That is, carriers flow from the source to the drain in the TFT.

In the n-type TFT, carriers are electrons and, as such, a source voltage is lower than a drain voltage in order to enable electrons to flow from the source to the drain. Current flows from the drain to the source in the n-type TFT because electrons flow from the source to the drain. On the other hand, in the p-type TFT, carriers are holes and, as such, a source voltage is higher than a drain voltage in order to enable holes to flow from the source to the drain. Current flows from the source to the drain in the p-type TFT because holes flow from the source to the drain. However, the source and the drain in such a TFT may be interchanged with each other in accordance with voltages applied thereto. In the following description, accordingly, one of the source and the drain is referred to as a "first electrode," and the other of the source and drain is referred to as a "second electrode," through reflection of the above-described phenomenon.

Figure 1:
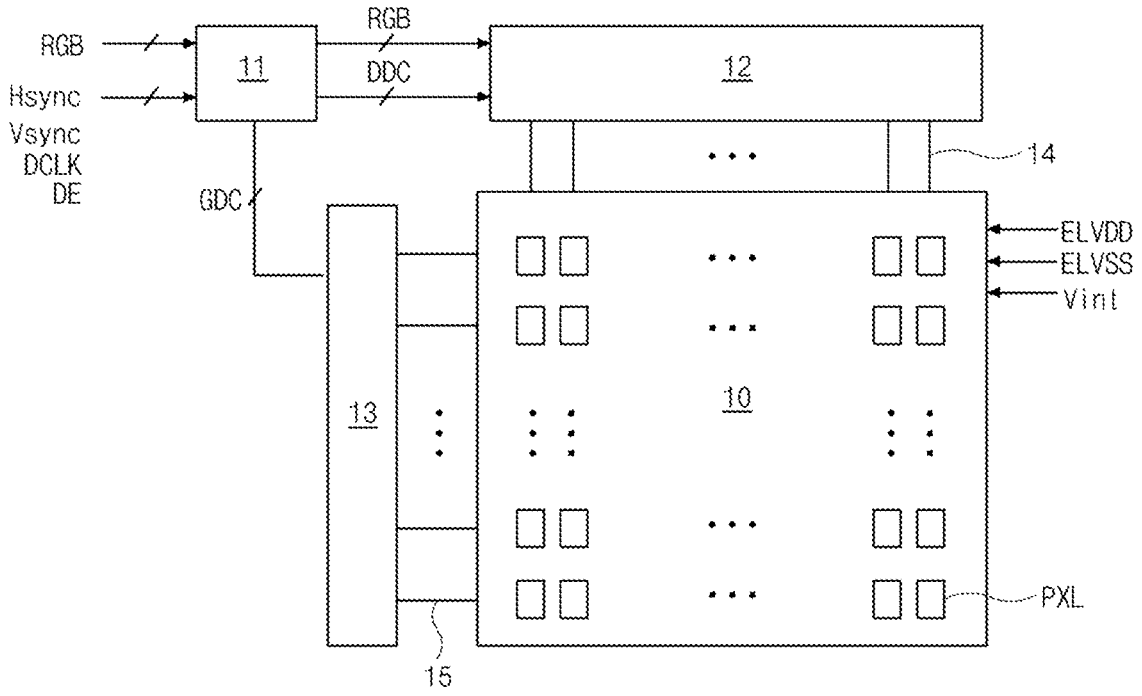
FIG. 1 is a block diagram schematically illustrating a configuration of an organic light emitting diode (OLED) display device according to an exemplary embodiment of the present disclosure.

FIG. 1 is a block diagram schematically illustrating a configuration of the OLED display device according to the exemplary embodiment of the present disclosure.

Referring to FIG. 1, the OLED display device according to the exemplary embodiment of the present disclosure includes a display panel 10 formed with pixels PXL for internal compensation, a data driving circuit 12 for supplying data voltages to data lines 14, a gate driving circuit 13 for driving gate lines 15, and a timing controller 11 for controlling driving timings of the data driving circuit 12 and the gate driving circuit 13.

In the display panel 10, a plurality of data lines 14 and a plurality of gate lines 15 are disposed in an intersecting manner, and sub-pixels PXL for internal compensation are disposed in a matrix at respective intersections of the data lines 14 and the gate lines 15. The sub-pixels PXL disposed on the same horizontal line are connected to one gate line 15. The gate line 15 may include at least one scan line and one emission control line.

That is, each sub-pixel PXL may be connected to one data line 14, at least one scan line, and one emission control line. Although not shown in FIG. 1, the sub-pixels PXL may receive a high-level voltage VDD, a low-level voltage VSS and a reference voltage Vref from a power supply. In order to prevent unnecessary light emission of an OLED in an initialization period and a sampling period, it is preferred that the reference voltage Vref be selected within a voltage range sufficiently lower than an operating voltage of the OLED. The reference voltage Vref may be set to be equal to or lower than the low-level voltage VSS.

Thin film transistors (TFTs) constituting each sub-pixel PXL may be embodied using oxide TFTs each including an oxide semiconductor layer. Such oxide TFTs are advantageous for a large size of the display panel 10 when electron mobility, process deviation, etc., are taken into consideration. Of course, embodiments of the present disclosure are not limited to the above-described conditions, and the semiconductor layer of each TFT may be made of amorphous silicon or polysilicon.

Each sub-pixel PXL may include a plurality of TFTs and a storage capacitor in order to compensate for a deviation of a threshold voltage Vth of a driving TFT. A detailed configuration of each sub-pixel PXL will be described later.

In the case of FIG. 1, each unit pixel may be constituted by at least three of a white (W) sub-pixel, a red (R) sub-pixel, a green (G) sub-pixel or a blue (B) sub-pixel, For example, the unit pixel may be constituted by sub-pixels in an R/G/B combination, sub-pixels in a W/R/G combination, sub-pixels in a B/W/R combination, sub-pixels in a G/B/W combination, or sub-pixels in a W/R/G/B combination.

The timing controller 11 rearranges digital video data RGB input from a host system in conformity with a resolution of the display panel 10, and supplies the rearranged digital video data RGB to the data driving circuit 12. The timing controller 11 generates a data control signal DDC for controlling operation timing of the data driving circuit 12 and a gate control signal GDC for controlling operation timing of the gate driving circuit 13 based on timing signals such as a vertical synchronization signal Vsync, a horizontal synchronization signal Hsync, a dot clock signal DCLK, and a data enable signal DE.

In addition, the timing controller 11 reads reference voltages EVref3 output from respective driving ICs of the data driving circuit 12, and compares the read reference voltages EVref3 for each driving IC. When a deviation is generated between the reference voltages EVref3 of the driving ICs, the timing controller 11 controls the reference voltage EVref output from each driving IC such that the reference voltages EVref output from respective driving ICs are equalized.

The data driving circuit 12 converts the digital video data RGB input from the timing controller 11 into an analog data voltage based on the data control signal DDC, and supplies the analog data voltage to the plurality of data lines 14. The data driving circuit 12 may include a plurality of driving ICs respectively configured to drive a plurality of blocks into which the data lines 14 are grouped.

The gate driving circuit 13 may generate scan signals Scan1 and Scan 2, and an emission control signal EM based on the gate control signal GDC. The gate driving circuit 13 may include a scan driver and an emission control signal driver. The scan driver may generate a scan signal in a row-sequence manner in order to drive at least one scan line connected to each pixel row, and may supply the scan signal to the scan lines. The emission control signal driver may generate an emission control signal EM in a row-sequential manner in order to drive at least one emission control signal line connected to each pixel row, and may supply the emission control signal EM to the emission control signal lines.

The gate driving circuit 13 as described above may be directly formed in a non-display area of the display panel 10 in a gate-driver in panel (GIP) manner.

Hereinafter each sub-pixel will also be referred to as a "pixel circuit."

Figure 2:
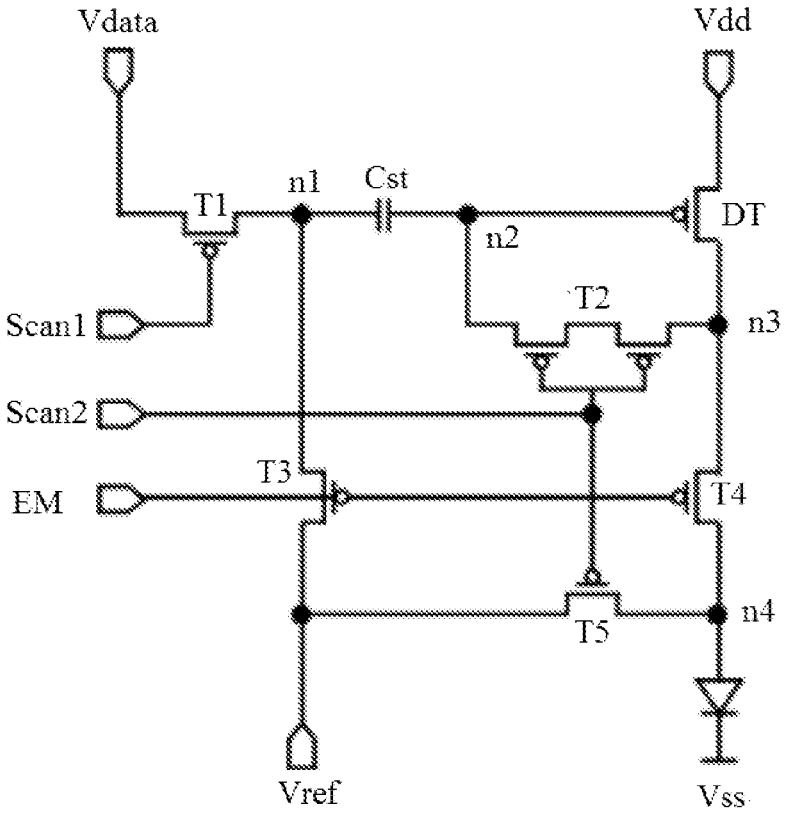
FIG. 2 is a circuit diagram of a configuration of each pixel circuit according to an exemplary embodiment of the present disclosure.

FIG. 2 is a circuit diagram of a configuration of each pixel circuit according to an exemplary embodiment of the present disclosure.

As illustrated in FIG. 2, the pixel circuit PXL includes an OLED element OLED, a first TFT T1, a second TFT T2, a third TFT T3, a fourth TFT T4, a fifth TFT T5, a driving TFT DT, and a storage capacitor Cst (6T1C).

First and second electrodes of the first TFT T1 are connected to a data line Vdata and a first node n1, respectively. A gate electrode of the first TFT T1 is connected to a first scan line Scan1. That is, the first TFT T1 turns on or off in accordance with a first scan signal Scan 1 applied thereto via the first scan line. When the first TFT T1 turns on, the first TFT T1 supplies a data voltage Vdata from the data line to the first node n1.

First and second electrodes of the second TFT T2 are connected to a second node n2 and a third node n3, respectively. A gate electrode of the second TFT T2 is connected to a second scan line Scan2. That is, the second TFT T2 turns on or off in accordance with a second scan signal Scan 2 applied thereto via the second scan line. When the second TFT T2 turns on, the second TFT T2 connects the second node n2 and the third node n3.

First and second electrodes of the third TFT T3 are connected to the first node n1 and a reference voltage supply line Vref, respectively. A gate electrode of the third TFT T3 is connected to an emission control signal supply line EM. That is, the third TFT T3 turns on or off in accordance with an emission control signal EM applied thereto via the emission control signal supply line. When the third TFT T3 turns on, the third TFT T3 supplies, to the first node n1, a reference voltage Vref supplied through the reference voltage supply line.

First and second electrodes of the fourth TFT T4 are connected to the third node n3 and a fourth node n4, respectively. A gate electrode of the fourth TFT T4 is connected to the emission control signal supply line EM. That is, the fourth TFT T4 turns on or off in accordance with the emission control signal EM applied thereto via the emission control signal supply line. When the fourth TFT T4 turns on, the fourth TFT T4 connects the third node n3 and the fourth node n4.

First and second electrodes of the fifth TFT T5 are connected to the reference voltage supply line Vref and the fourth node n4, respectively. A gate electrode of the fifth TFT T5 is connected to the second scan line Scan2. That is, the fifth TFT T5 turns on or off in accordance with the second scan signal Scan2 applied thereto via the second scan line. When the fifth TFT T5 turns on, the fifth TFT T5 supplies, to the fourth node n4, the reference voltage Vref supplied through the reference voltage supply line.

First and second electrodes of the driving TFT DT are connected to a high-level voltage supply line Vdd and the third node n3, respectively. A gate electrode of the driving TFT DT is connected to the second node n2. That is, the driving TFT DT turns on or off in accordance with a voltage at the second node n2. When the driving TFT DT turns on, the driving TFT DT supplies, to the third node n3, a high-level voltage Vdd supplied through the high-level voltage supply line.

The storage capacitor Cst is connected between the first node n1 and the second node n2 to constantly sustain the data voltage Vdata supplied through the first TFT T1 for one frame. That is, the storage capacitor Cst constantly sustains a gate-source voltage Vgs of the driving TFT DT for one frame.

An anode of the OLED element OLED is connected to the fourth node n4, and a cathode of the OLED element OLED is connected to a low-level voltage supply line Vss.

Although the 6T1C pixel circuit is illustrated in FIG. 2, embodiments of the present disclosure are not limited thereto, and any pixel circuit using a reference voltage Vref, which may include a 3T1C pixel circuit, may be applied to embodiments of the present disclosure.

That is, a reference voltage may be needed when it is required to sense a threshold voltage Vth or mobility μ of a driving TFT or to compensate a deviation of the threshold voltages Vth of the driving TFTs.

However, if a deviation occurs in the reference voltages supplied for each driving ICs, the threshold voltage Vth or mobility μ of the driving TFT is sensed by using the reference voltage in which the deviation occurs, or the deviation of the threshold voltage Vth of the driving TFT is compensated by using the deviated reference voltage, correct compensation may not be achieved and, as such, a block dimming phenomenon may occur.

Embodiments of the present disclosure solve such a problem. That is, a reference voltage controller and an analog to digital converter are provided for each driving IC, and the timing controller reads reference voltages EVref3 output from respective driving ICs of the data driving circuit via respective analog to digital converters, and compares the reference voltages EVref3 for each driving IC. When a deviation occurs in the reference voltages EVref3 for each driving ICs, the timing controller controls the reference voltage controller of each driving IC such that the same reference voltage EVref is output from all driving ICs.

Figure 3:
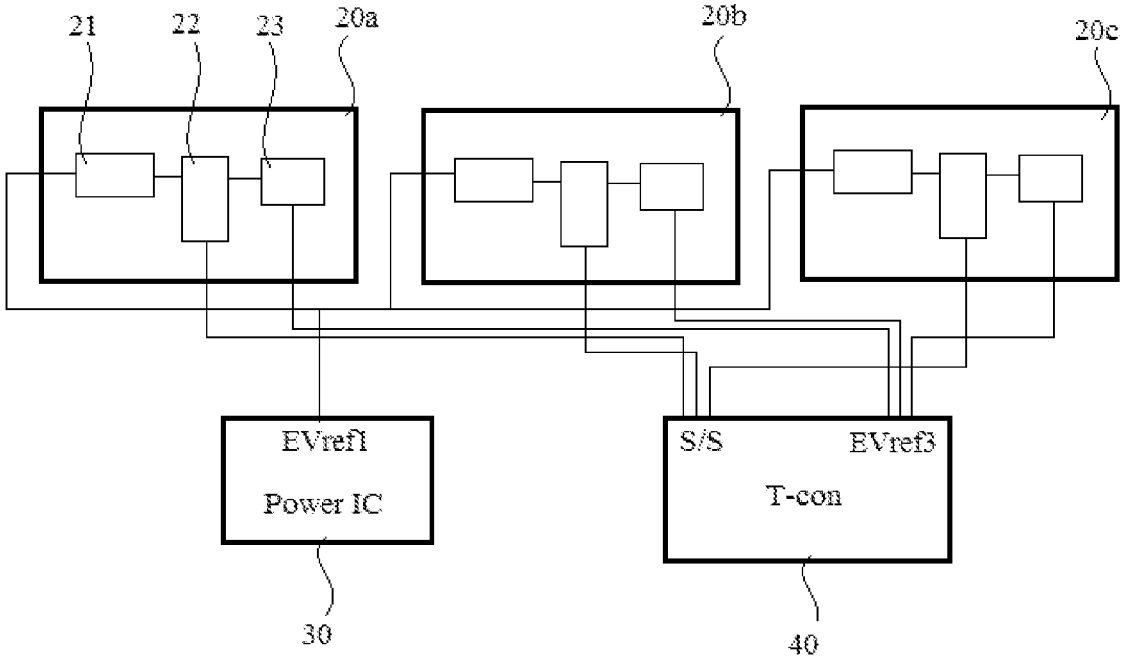
FIG. 3 is a block diagram illustrating configurations of a data driving circuit and a timing controller associated with a reference voltage in the OLED display device according to the exemplary embodiment of the present disclosure in more detail.

FIG. 3 is a block diagram illustrating configurations of the data driving circuit and the timing controller associated with the reference voltage in the OLED display device according to the exemplary embodiment of the present disclosure in more detail.

Figure 4:
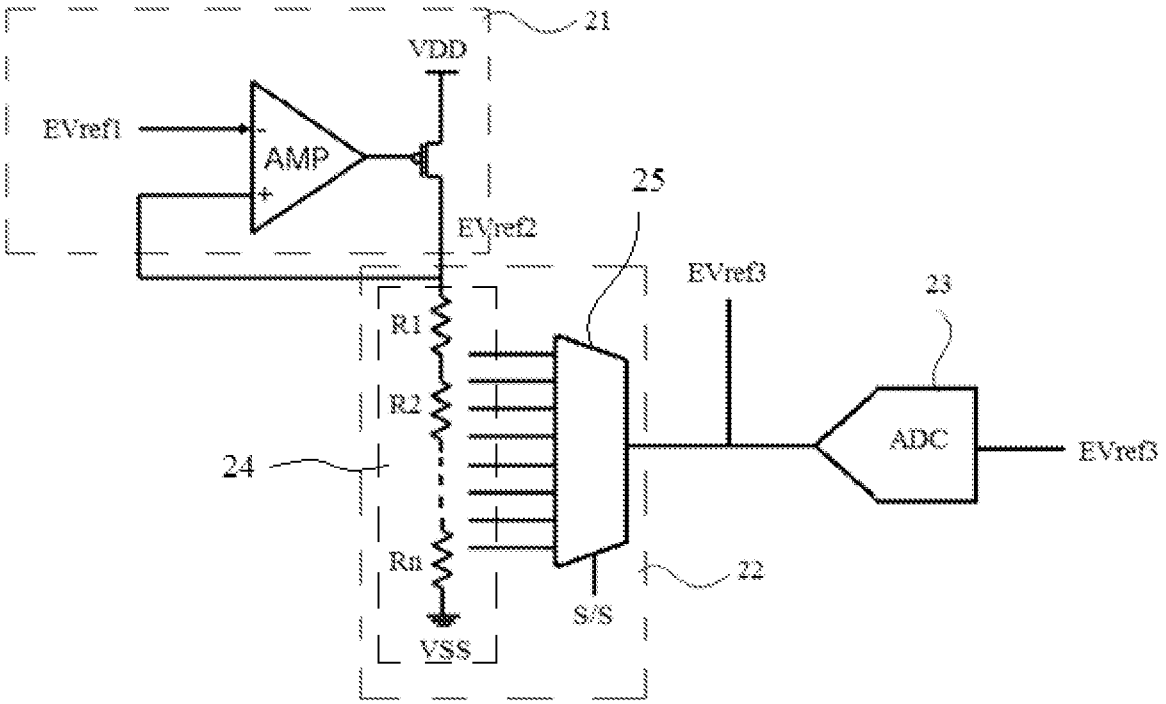
FIG. 4 is a circuit diagram illustrating a reference voltage generator, a reference voltage controller, and an analog to digital converter in each driving integrated circuit (IC) of FIG. 3 in more detail.

FIG. 4 is a circuit diagram illustrating the reference voltage generator, the reference voltage controller, and the analog to digital converter in each driving IC of FIG. 3 in more detail.

The data driving circuit 12 of the OLED display device according to the exemplary embodiment of the present disclosure described in conjunction with FIG. 1 is constituted by a plurality of driving ICs 20*a*, 20*b*, and 20*c*, as illustrated in FIG. 3.

The timing controller 40 in the OLED display device according to the exemplary embodiment of the present disclosure reads reference voltages EVref3 respectively output from the driving ICs 20*a*, 20*b* and 20*c* of the data driving circuit 12, and compares the reference voltages EVref3 output from the driving ICs 20*a*, 20*b* and 20*c*. When a deviation occurs in the reference voltages EVref3 of the driving ICs 20*a*, 20*b* and 20*c*, the timing controller controls the reference voltage EVref3 output from each driving IC such that the reference voltages EVref3 output from all driving ICs are equalized. The timing controller 11 described in conjunction with FIG. 1 is illustrated as a timing controller 40 in FIG. 3.

A power supply (power IC) 30 supplies a reference voltage EVref1 to each of the driving ICs 20*a*, 20*b* and 20*c*.

The timing controller 40 receives reference voltages EVref3 respectively output from the driving ICs 20*a*, 20*b*, and 20*c* to the display panel after converting each reference voltage EVref3 into a digital signal, and compares the reference voltages EVref3 of the driving ICs 20*a*, 20*b*, and 20*c*. When a deviation occurs in the reference voltages EVref3 of the driving ICs 20*a*, 20*b* and 20*c*, the timing controller 40 outputs a select signal S/S to each of the driving ICs 20*a*, 20*b* and 20*c* in order to perform control to equalize the reference voltages EVref3 respectively output from the driving ICs 20*a*, 20*b* and 20*c*. For example, when a deviation occurs in the reference voltages EVref3 of the driving ICs 20*a*, 20*b* and 20*c*, the timing controller 40 outputs a select signal S/S to each of the driving ICs 20*a*, 20*b* and 20*c* such that a lowest one of the reference voltages EVref3 is output from each of the driving ICs 20*a*, 20*b* and 20*c* as a reference voltage.

Each of the driving ICs 20*a*, 20*b* and 20*c* includes a reference voltage generator 21 for receiving the reference voltage EVref1 (initial reference voltage) supplied from the power supply (power IC) 30, generating a reference voltage EVref2 (intermediate reference voltage) based on the reference voltage EVref1, and outputting the generated reference voltage EVref2, a reference voltage adjuster 22 for adjusting the reference voltage EVref2 generated in the reference voltage generator 21, and outputting the adjusted reference voltage EVref2 (reference voltage EVref3) to the display panel, and an analog to digital converter 23 for converting the reference voltage EVref3 output from the reference voltage adjuster 22 into a digital signal (EVref3 in digital form), and transmitting the digital signal to the timing controller 40.

Although the reference voltage generator 21 is illustrated as including an amplifier AMP in FIG. 4, the reference voltage generator 21 is not limited thereto, and may further include a sampling circuit, etc.

The reference voltage adjuster 22 includes a divider 24 configured by a plurality of resistors R1, R2, . . . , and Rn connected in series to divide the reference voltage EVref2 output from the reference voltage generator 21 into voltages of multiple levels, and a multiplexer 25 for selecting one of the voltages divided in the divider 24 in accordance with the select signal S/S output from the timing controller 40, and supplying the selected voltage to the display panel as the reference voltage EVref3.

As described above, the data driving circuit 12 is constituted by a plurality of driving ICs 20*a*, 20*b*, and 20*c*, and the timing controller 40 compares the reference voltages EVref3 respectively output from the driving ICs 20*a*, 20*b*, and 20*c* to the display panel. When a deviation occurs in the reference voltages EVref3 of the driving ICs 20*a*, 20*b* and 20*c*, the timing controller 40 controls the driving ICs 20*a*, 20*b* and 20*c* such that the reference voltages EVref3 respectively output from the driving ICs 20*a*, 20*b* and 20*c* are equalized.

Accordingly, it may be possible to prevent a deviation of reference voltages for each driving ICs, to precisely sense the threshold voltage Vth or mobility μ of the driving TFT, and to precisely compensate for a deviation of the threshold voltage Vth of the driving TFT. In addition, a block dimming phenomenon caused by a reference voltage deviation may be avoided.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting diode (OLED) display device, comprising:

a display panel having a plurality of reference voltage lines and a plurality of pixels;

a data driving circuit having at least a first driving integrated circuit and a second driving integrated circuit, each of the first and second driving integrated circuits configured to generate a reference voltage and configured to selectively supply the reference voltage to the plurality of reference voltage lines of the display panel; and a timing controller for comparing a first reference voltage from the first driving integrated circuit and a second reference voltage from the second driving integrated circuit, and for controlling the first and second driving integrated circuits to cause that the first reference voltage and the second reference voltage are equalized.

2. The OLED display device according to claim 1, wherein each pixel of the plurality of pixels includes a driving thin film transistor for controlling current flowing through a light emitting element, at least one switching thin film transistor for sensing a threshold voltage or mobility of the driving thin film transistor or compensating for a threshold voltage deviation of the driving thin film transistor, and at least one storage capacitor.

3. The OLED display device according to claim 1, wherein the timing controller is configured to compare the first reference voltage and the second reference voltage and configured to control each of the first and second driving integrated circuits to output a lowest voltage out of the reference voltages output from the first and second driving integrated circuits as the reference voltage when a deviation occurs in the first and second reference voltages of the first and second driving integrated circuits.

4. The OLED display device according to claim 1, wherein each of the first and second driving integrated circuits includes:

a reference voltage generator for receiving an initial reference voltage supplied from a power supply, generating an intermediate reference voltage based on the received initial reference voltage, and outputting the generated intermediate reference voltage;

a reference voltage adjuster for adjusting the intermediate reference voltage generated from the reference voltage generator under control of the timing controller, and outputting the adjusted intermediate reference voltage as the reference voltage to the respective reference voltage line of the reference voltage lines of the display panel; and an analog to digital converter for converting the reference voltage output from the reference voltage adjuster into a digital signal, and transmitting the digital signal to the timing controller.

5. The OLED display device according to claim 4, wherein the reference voltage adjuster includes:

a divider for dividing the intermediate reference voltage output from the reference voltage generator into voltages of multiple levels; and a multiplexer for selecting one of the voltages divided in the divider in accordance with a select signal output from the timing controller, and supplying the selected voltage to the respective reference voltage line of the reference voltage lines of the display panel as the reference voltage.

6. An organic light emitting diode (OLED) display device, comprising:

a display panel having a plurality of reference voltage lines and a plurality of pixels;

a data driving circuit having a plurality of driving integrated circuits including a first driving integrated circuit and a second driving integrated circuit, each of the plurality of driving integrated circuits configured to generate a reference voltage and configured to selectively supply the reference voltage to a respective reference voltage line of the plurality of reference voltage lines of the display panel; and a timing controller for comparing the reference voltages output from the plurality of driving integrated circuits to the display panel, the reference voltages including a first reference voltage from the first driving integrated circuit and a second reference voltage from the second driving integrated circuit, and for controlling the plurality of driving integrated circuits to cause that the reference voltages including the first reference voltage and the second reference voltage are equalized;

wherein each of the plurality of driving integrated circuits includes:

a reference voltage generator for receiving an initial reference voltage supplied from a power supply, generating an intermediate reference voltage based on the received initial reference voltage, and outputting the generated intermediate reference voltage;

a reference voltage adjuster for adjusting the intermediate reference voltage generated from the reference voltage generator under control of the timing controller, and outputting the adjusted intermediate reference voltage as the reference voltage to the respective reference voltage line of the reference voltage lines of the display panel; and an analog to digital converter for converting the reference voltage output from the reference voltage adjuster into a digital signal, and transmitting the digital signal to the timing controller;

wherein the reference voltage adjuster includes:

a divider for dividing the intermediate reference voltage output from the reference voltage generator into voltages of multiple levels; and a multiplexer for selecting one of the voltages divided in the divider in accordance with a select signal output from the timing controller, and supplying the selected voltage to the respective reference voltage line of the reference voltage lines of the display panel as the reference voltage.

* * * * *